United States Patent [19]

Slavik et al.

[11] Patent Number: 4,515,320

[45] Date of Patent: May 7, 1985

[54] TRAVERSE WINDING FRAME FOR PRODUCING THE WINDING OF A PACKAGE

[75] Inventors: Walter Slavik, Horgen; Arthur Rebsamen, Sellenburen, both of Switzerland

[73] Assignee: Maschinenfabrik Schweiter AG, Horgen, Switzerland

[21] Appl. No.: 536,323

[22] Filed: Sep. 27, 1983

[30] Foreign Application Priority Data

Sep. 27, 1982 [CH] Switzerland ..... 5689/82

[51] Int. Cl.[3] ..... B65H 54/08; B65H 54/28

[52] U.S. Cl. ..... 242/18 DD; 242/18.1; 242/43 R

[58] Field of Search ..... 242/18 DD, 18 R, 43 R, 242/18 G, 18.1

[56] References Cited

U.S. PATENT DOCUMENTS

| | | | |
|---|---|---|---|
| 3,491,960 | 1/1970 | Furst | 242/18 DD |
| 3,982,706 | 9/1976 | Delerue | 242/18 DD |
| 4,371,122 | 2/1983 | Schuller | 242/43 R |

*Primary Examiner*—Stanley N. Gilreath

*Attorney, Agent, or Firm*—Roylance, Abrams, Berdo & Goodman

[57] ABSTRACT

A winding station in a traverse winding frame for winding thread on a package comprises a belt drive for rotating a cheese or bobbin via a driving roller and a grooved drum for thread laying. The grooved drum drive has a continuously variable gear, whose speed is continuously variable by an adjusting linkage. The speed of the cheese and the grooved drum is measured by two tachometers and supplied as a corresponding signal to a computer, in which the actual value calculated from the two signals is compared with a desired value stored in the computer and a correction signal is then fed to a control element for adjusting the adjusting linkage. Thus, the cheese can be wound with a thread winding, which combines the advantages of a random winding with a constant pitch angle and a precision winding with a substantially constant turns ratio during partial windings, without suffering from their disadvantages.

5 Claims, 5 Drawing Figures

TRAVERSE WINDING FRAME FOR PRODUCING THE WINDING OF A PACKAGE

FIELD OF THE INVENTION

The invention relates to an apparatus for winding a thread into a package. More specifically, the invention relates to an apparatus for producing the winding of a cheese by winding a continuously supplied thread or by rewinding a thread from a yarn package. The cheese is peripherally driven by a driving roller and the thread is supplied by means of a thread laying device. The invention also relates to a traverse winding frame for performing this method.

BACKGROUND OF THE INVENTION

It is known to make a thread package in the form of a cheese or bobbin by winding, i.e., a thread is wound onto a support or carrying member, e.g., a winding mandrel, spool or the like. Two winding methods are known, namely the so-called random winding and the precision winding. In the case of a random winding, the thread is wound onto a package, i.e., a bobbin or cheese peripherally driven by a driving cylinder, the thread being supplied by means of a grooved drum or a thread guide guided by a grooved drum and is placed on the package. The grooved drum is in constant rotary connection with the driving cylinder. However, this method only makes it possible to produce random windings, i.e., windings whose "turns ratio" decreases with the increasing package diameter, the pitch or helix angle of the thread laying device remaining constant. The term "turns ratio" is understood to mean the number of turns, i.e., revolutions, of the package per double stroke of the thread from the thread laying device. A "stroke" is the removal of thread from one end of the thread laying device to the other, so a double stroke comprises the thread removal from one end to the other end and then back to the starting end.

It is necessary when producing a precision winding that, in the winding machine, the thread laying device is connected in a positively engaged manner with the cheese or spool holder. The turns ratio of the cheese turns to the double stroke of the thread remains constant throughout the precision winding process, i.e., the pitch angle of the thread onto the cheese from the thread laying device changes and becomes more acute with increasing cheese diameter. In this winding method, the cheese is driven at its shaft and for obtaining a constant turns ratio the thread laying device is in positively engaging rotary connection with the cheese.

The two winding methods differ in various ways. Random winding is characterized by a constant pitch angle $\alpha$ of the thread laying device over the entire cheese diameter, which leads to a good dimensional stability and transportability. By the coupling of the driving roller and the thread laying system, a simpler mechanical construction of the traverse winding frame is obtained. Disadvantages result from unfavorable numbers of turns, which become noticable during the formation of the cheese at specific cheese diameters, constituting so-called images. A non-uniform yarn twisting results from these so-called image areas and this can subsequently lead to uncertain removal conditions. Due to the fact that the precision-wound cheese has no such image areas very good removal characteristics are obtained. As the pitch angle $\alpha$ of the thread laying device varies significantly during cheese formation, the dimensional stability is poor. Attempts have been made to obtain improved cheese stability involving considerable technical effort and expenditure (i.e., bobbin stirrup relief, blocking relief, etc.), but the results leave much to be desired.

Thus, in summarizing, it can be stated that precision winding leads to no problems with respect to the cheese removal characteristics, whereas considerable expenditure is involved regarding the cheese shape and construction, particularly in the case of large cheeses with elastic and bulky yarns (textured yarns). With random winding there are no problems regarding the bobbin construction, e.g., in view of the dimensional stability, but additional expenditure is required in connection with the cheese removal characteristics.

The problem of the present invention is therefore to so develop the winding machine of the aforementioned type so that the advantages of precision winding can be combined with those of random winding in such a way that it is possible to obtain a better cheese removal, dimensional stability and transportability of the cheese in a simple manner and with limited expenditure.

SUMMARY OF THE INVENTION

According to the invention this problem is solved by a method in which a cheese is wound with a precision winding, whose number of turns is changed in each case after an interval of time within which the pitch angle $\alpha$ of the thread laying device is within a selected tolerance range ($\alpha_1$-$\alpha_2$) during the complete cheese formation process, and by a traverse winding frame, in which a tachometer measuring the rotational speed of the cheese and a tachometer measuring the rotational speed of the thread laying device is in each case connected to a computer for comparing the desired and actual values for the numbers of turns and for producing a correction signal for adjusting a control element connected to the computer for adapting the actual number of turns to the desired number of turns. Thus, in each diameter the cheese has a precision winding with a constant turns ratio and simultaneously the average pitch angle remains constant from the start to the finish of the cheese.

In particular, the foregoing problem is solved by providing a method for producing the winding of a thread into a package comprising the steps of supplying the thread to a shaft via a thread laying device to form the package, and rotating the package via a rotating driving roller engaging the package periphery to wind the thread onto the package while adjusting the turns ratio between the number of turns of the package per each double stroke of the thread from the thread laying device during a predetermined series of partial windings of the package to provide a constant turns ratio during each partial winding, and maintaining the pitch angle of the thread on the package within a predetermined tolerance range throughout each of the series of partial windings.

The problem is also solved by a traverse winding frame for producing the winding of a thread into a package, the combination comprising first means for rotatably supporting a shaft; second means for rotating the shaft and for supplying a thread to the shaft to form the package, said second means including a rotatable thread laying device; sensing means for sensing the rotational speed of the package and the rotational speed of the thread laying device; and control means, coupled and responsive to said sensing means and coupled to said second means, for adjusting said second means to thereby adjust the turns ratio between the number of turns of the package per each double stroke of the thread from said thread laying device during a predetermined series of partial windings of the package to provide a constant turns ratio during each partial winding, and maintain the pitch angle of the thread on the package within a predetermined tolerance range throughout each of the series of partial windings.

This package has good unwinding and dimensional stability characteristics, although the technical expenditure is relatively low. A tachometer is required for measuring the package rotational speed and for measuring the thread guide rotational speed and these tachometers are connected to a computer which, by means of a control element, adapts the winding number actual value to the desired value.

DRAWINGS

The invention is described in greater detail hereinafter relative to two embodiments and the attached drawings, wherein.

DETAILED DESCRIPTION OF THE INVENTION

Figure 1:
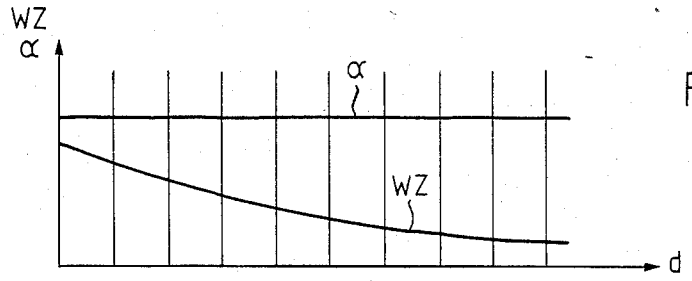
FIGS. 1–3 show graphs relating to the winding number WZ and the pitch angle $\alpha$ of the thread laying device over the cheese diameter d, FIG. 1 showing the conditions with a conventional random winding, FIG. 2 the conditions with a conventional precision winding, and FIG. 3 the conditions with the winding according to the invention.

The winding of a cheese, with a random winding in the winding station of a traverse winding frame is illustrated by means of FIG. 1, in which the pitch angle $\alpha$ of the thread laying device and the number of turns of cheese WZ are shown over the cheese diameter d, it being assumed that the driving roller of the winding station is operated at a constant speed. The pitch angle $\alpha$ remains constant, but the number of turns decreases constantly as the winding diameter d increases.

Figure 2:
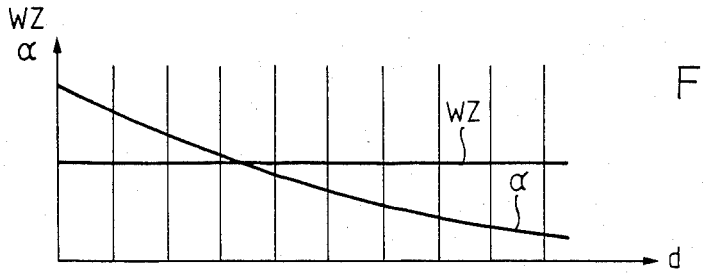

FIG. 2 shows the winding of a cheese with a precision winding. The number of turns WZ remains constant, but the pitch angle $\alpha$ becomes smaller, i.e., more acute with increasing cheese diameter d.

Figure 3:
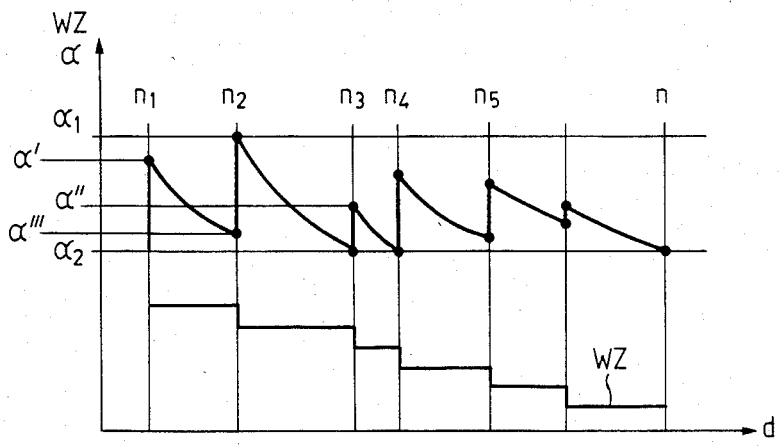

Whereas FIGS. 1 and 2 represent the prior art, FIG. 3 illustrates the winding of a cheese by a traverse winding frame with the winding according to the invention. The winding process is subdivided into a series of individual partial precision windings $n_1$, $n_2$, . . . n with random diameter ratios. The number of turns of the cheese remains constant within each such partial winding, while the pitch angle is reduced within a tolerance range $\alpha_1$-$\alpha_2$. In each of the following partial precision windings, the number of turns is reduced, but remains constant during such partial winding so that the pitch angle $\alpha$ passes to a higher value. Appropriately the relationships are selected in such a way that the number of turns in each partial winding so decreases that the pitch angle in each case again reaches a higher value within the tolerance range $\alpha_1$-$\alpha_2$ and remains constant, apart from the indicated tolerance. The pitch angle tolerance can be selected in a random manner within the tolerance range $\alpha_1$-$\alpha_2$ for each partial precision winding $n_1$, $n_2$, . . . n, e.g., for winding $n_1$ $\alpha'$-$\alpha'''$, for winding $n_2$ $\alpha_1$-$\alpha_2$, etc. Appropriately, the lower tolerance value for all precision windings is kept constant, e.g., $\alpha_2$. However, the winding of a cheese with a constant pitch angle and decreasing number of turns characterizes a random winding. Thus, the winding according to the invention represents a combination of a random winding with a substantially constant average pitch angle and a precision winding with a constant turns ratio during each partial winding.

Figure 4:
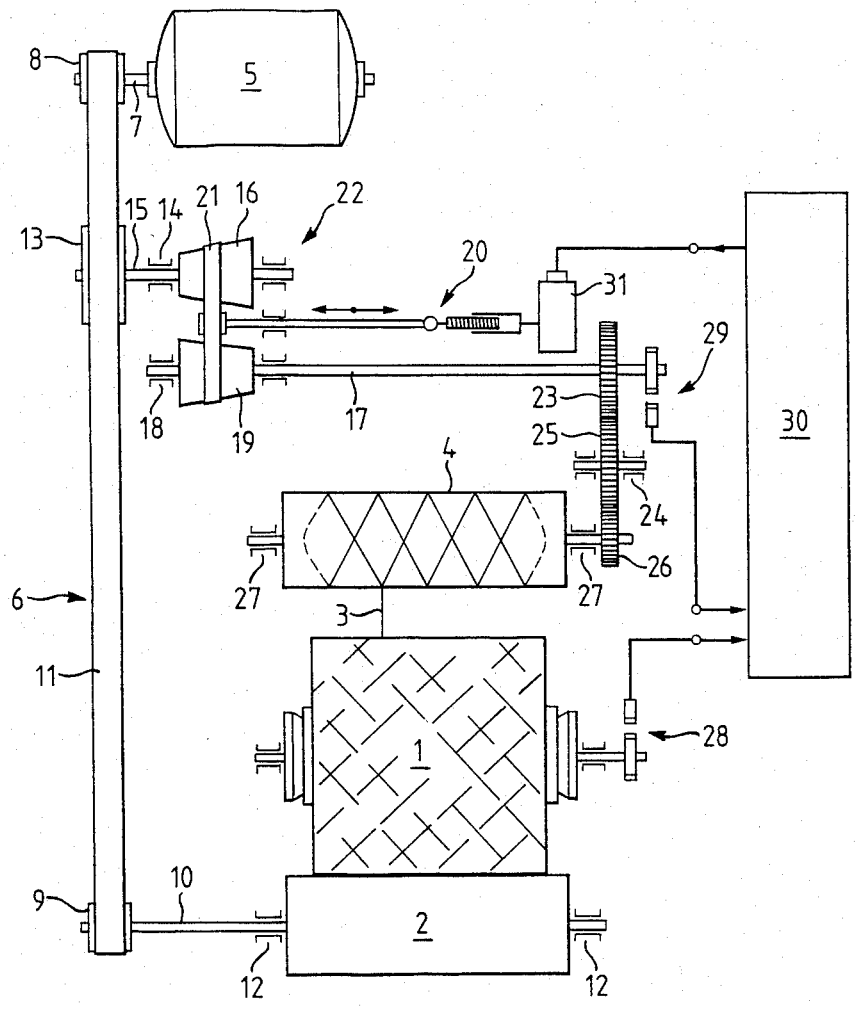
FIG. 4 is a diagrammatic representation of a traverse winding frame according to the invention.

The traverse winding frame diagrammatically shown in FIG. 4, including only one winding station, makes it possible to wind a cheese 1 with the winding according to the invention illustrated in FIG. 3. The periphery of cheese 1 is driven by a rotary driving roller 2, the thread 3 to be wound being supplied by means of a grooved drum 4 of some other thread laying system to cheese 1 on which it is placed.

Driving roller 2 is driven at a constant speed by a motor drive 5 by means of belt drive 6 and which comprises a driving pinion 8 located on driving shaft 7 of motor drive 5, a driven pinion 9 on driven shaft 10 and a belt 11. Driven shaft 10 also carries the driving roller 2, which is mounted in rotary manner in diagrammatically represented bearings 12.

Belt drive 6 comprises a further driven pinion 13, whose shaft 15 is mounted in bearing 14 and carries a conical drum 16 which, with an oppositely arranged conical drum 19 mounted in a rotary manner in bearings 18 by a shaft 17 and a belt 21 looping the conical drums 16, 19 and displaceable by an adjusting linkage 20, forms a conversion means 22, whose speed is continuously adjustable. Shaft 17 carries a toothed gear 23, which drives the grooved drum 4 mounted in a rotary manner in bearings 27 by means of a toothed gear 25 mounted in a rotary manner in bearings 24 and by means of a pinion 26 coupled to a shaft supporting drum 4.

Belt drive 6, conversion means 22 and means 23, 25, 26 are exemplified solutions and can be partially or completely replaced by equivalent mechanical, electrical or hydraulic drives.

The rotational speed of cheese 1 and grooved drum 4 or the grooved drum-guided thread guide is measured by tachometers 28, 29 and the speed values are supplied in the form of electrical signals to the computer 30. In FIG. 4, tachometer 28 measures the speed of the shaft supporting cheese 1 and tachometer 29 measures the speed of shaft 17, which has a fixed gearing ratio with the speed of the grooved drum or the grooved drum-guided thread guide 4. The actual turns ratio, which is understood to mean the number of cheese turns per double stroke of the thread, is calculated from the two speed signals supplied to computer 30 and is compared with a desired turns ratio. As can be gathered from FIG. 3, this desired turns ratio is a constant value for each partial winding. Divergences from this desired value are corrected by the computer in the form of a correction signal to a linear drive 31 of adjusting linkage 20 of conversion means 22, so that the latter is adjusted in the sense of adapting the calculated actual value to the desired value. Drive 31 can be, for example, a hydraulic cylinder and piston motor for longitudinally displacing linkage 20 as illustrated by the double-headed arrow in FIG. 4. As can be gathered from FIG. 3, a different turns ratio is decisive, i.e., required, for each partial winding. These values are stored in the computer and are polled at the end of each partial winding, so that there is a rapid adjustment of the adjusting linkage 20 for establishing the new turns ratio. The pitch angle tolerance represented in FIG. 3 is 0° to max. 3° so that the transition to the new turns ratio can take place very rapidly. This is represented in FIG. 3 by the sawtooth line for the course of pitch angle $\alpha$ and the sudden transition from one windings number to the next. In reality, this transition takes place in a finite period of time and consequently differs slightly from the theoretical representation of FIG. 3.

Figure 5:
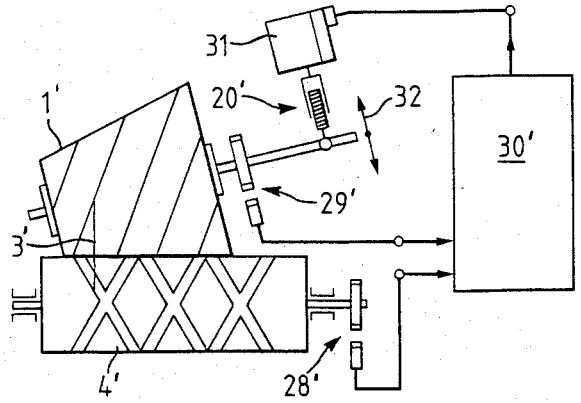
FIG. 5 is a variant of the traverse winding frame according to the invention.

Embodiment of FIG. 5

FIG. 5 shows the winding of a conical cheese or bobbin 1' with the winding according to the invention, the same objects being given the same reference numerals as in FIG. 4 but with a prime. In this case grooved drum 4' is both a driving roller and the thread laying grooved drum. Speed of cheese 1' and grooved drum 4' is evaluated in the same way in computer 30' and the correction signal is fed to servo-drive 31', which carries out a corresponding change to the slope of the rotational axis of cheese 1 and consequently a change in the cheese diameter decisive for the cheese speed in the sense of adapting the actual value to the desired value. The change to the cheese axis slope is indicated by two arrows 32.

During the operation of the described winding station, the bobbin or cheese diameter, or the turns ratio, is given at the start of winding. When the cheese reaches a specific given minimum pitch angle, given by the selected tolerance, the computer changes to a given lower number of turns. This sudden change to an approximately constant pitch angle $\alpha$ takes place in preselectable cheese diameter stages until the final diameter of the cheese is reached. The cheese produced in this way have an approximately constant pitch angle $\alpha$ and the turns ratio is changed in jumps by computer. The tolerance of pitch angle $\alpha$ can be selected within narrow limits, e.g., 0° to 5°, preferably 0° to 3°, and most preferably 0° to 1°.

While various advantageous embodiments have been chosen to illustrate the invention, it will be understood by those skilled in the art that various changes and modifications can be made therein without departing from the scope of the invention as defined in the appended claims.

What is claimed is:

1. A transverse winding frame for precision winding of thread into a package, comprising:

package support means for rotatably supporting a package to be wound with thread;

a rotatably mounted friction roller for rotatably driving the package;

a rotatably mounted cam shaft supporting a thread laying device;

a single constant-speed drive motor for powering rotation of said friction roller and said cam shaft;

a belt transmission coupling said drive motor to said friction roller and said cam shaft;

infinitely variable transmission means, coupling said belt transmission to said cam shaft, for varying rotation speed of said cam shaft, said variable transmission means including a servomotor for operating said variable transmission means;

first and second tachometers operatively coupled to said package support means and said cam shaft, respectively, for generating output signals representative of rotation speeds of the package and said cam shaft; and control means, coupled to said tachometers and said servomotor, for comparing said output signals of said tachometers and for transmitting a control signal to said servomotor dependent upon said output signals and upon preprogrammed helix angle tolerances and winding ratios.

2. A transverse winding frame according to claim 1 wherein said tread laying device is a grooved drum.

3. A transverse winding frame according to claim 1 wherein said variable transmission means comprises a conoid variator.

4. A transverse winding frame for precision winding of a thread into a package, comprising:

package support means for rotatably supporting a package to be wound with thread about a package axis;

a rotatably mounted cam shaft supporting a thread laying means for laying thread on the package and contacting and rotatably driving the package;

a single constant-speed drive motor coupled to and rotating said cam shaft;

servo-drive means, coupled to said package support means, for variably orienting said package axis relative to said thread laying means;

first and second tachometers operatively coupled to said package support means and said cam shaft, respectively, for generating output signals representative of rotation speeds of the package and said cam shaft; and control means, coupled to said tachometers and said servo-drive means, for comparing said output signals of said tachometers and for transmitting a control signal to said servo-drive means dependent upon said output signals and upon preprogrammed helix angle tolerances and winding ratios.

5. A transverse winding frame according to claim 4 wherein said servo-drive means varies a relative angular orientation between said package axis and said thread laying means.

* * * * *